US006499547B2

(12) United States Patent
Scott et al.

(10) Patent No.: US 6,499,547 B2
(45) Date of Patent: Dec. 31, 2002

(54) MULTIPLE GRADE CARBIDE FOR DIAMOND CAPPED INSERT

(75) Inventors: Danny E. Scott, Montgomery, TX (US); Marcus R. Skeem, Sandy, UT (US)

(73) Assignee: Baker Hughes Incorporated, Houston, TX (US)

( * ) Notice: Subject to any disclaimer, the term of this patent is extended or adjusted under 35 U.S.C. 154(b) by 43 days.

(21) Appl. No.: 09/799,259

(22) Filed: Mar. 5, 2001

(65) Prior Publication Data

US 2001/0008190 A1 Jul. 19, 2001

Related U.S. Application Data

(63) Continuation-in-part of application No. 09/231,350, filed on Jan. 13, 1999, now Pat. No. 6,220,375.

(51) Int. Cl.[7] ..... E21B 10/56

(52) U.S. Cl. ..... 175/374; 175/428; 175/420.2; 175/434; 175/415

(58) Field of Search ..... 175/428, 420.2, 175/426, 434, 414, 415, 374; 51/277, 293, 295, 309

(56) References Cited

U.S. PATENT DOCUMENTS 4,604,106 A * 8/1986 Hall et al.
4,694,918 A * 9/1987 Hall
4,811,801 A * 3/1989 Salesky
5,304,342 A * 4/1994 Hall et al.
5,335,738 A * 8/1994 Waldenstrom et al.
5,370,195 A 12/1994 Keshavan et al. ..... 175/420.2
5,496,638 A 3/1996 Waldenstrom et al. ..... 428/408
5,549,980 A 8/1996 Ostlund et al. ..... 428/698
5,624,068 A 4/1997 Waldenstrom et al. . 228/262.21
5,755,299 A 5/1998 Langford, Jr. et al. ..... 175/375

OTHER PUBLICATIONS

Residual Stresses in .529 from Baker Hughes Cutter Control #D1086C.

* cited by examiner

*Primary Examiner*—Roger Schoeppel
(74) *Attorney, Agent, or Firm*—Bracewell & Patterson, L.L.P.

(57) ABSTRACT

An insert for a rolling cone earth-boring bit has a cylindrical base that interferingly presses into a mating hole formed in a cone of the bit. The insert has a convex end that extends from the base. A polycrystalline diamond cap is bonded to the convex end. The body is formed of at least two layers of carbide material having different mechanical properties, particularly a different modulus of elasticity. The first layer may have a metallic binder with a lesser percentage than the binder of the second layer to reduce the stress at the interface between the first layer and the diamond cap. The layers may have different average carbide grain sizes, with finer average grain sizes adjoining the diamond cap. Further, the layers may have different binders, with cobalt being the binder in the layer adjoining the diamond cap and either nickel or a nickel-cobalt alloy in another layer.

25 Claims, 4 Drawing Sheets

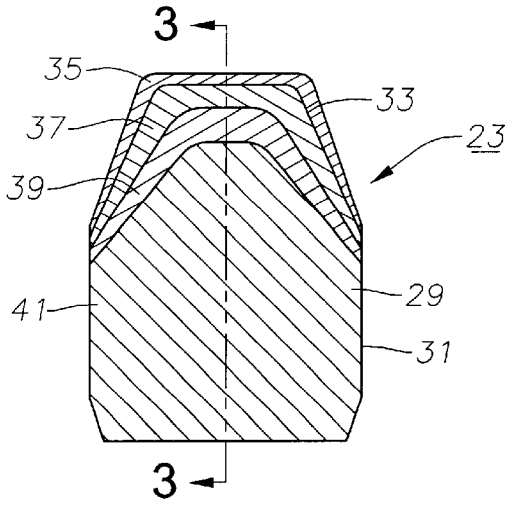
Fig. 2
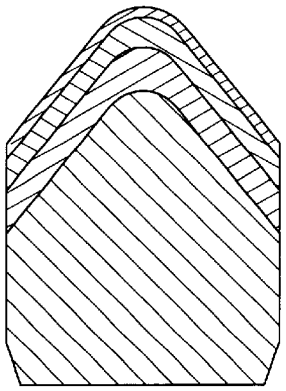
Fig. 3
Fig. 4
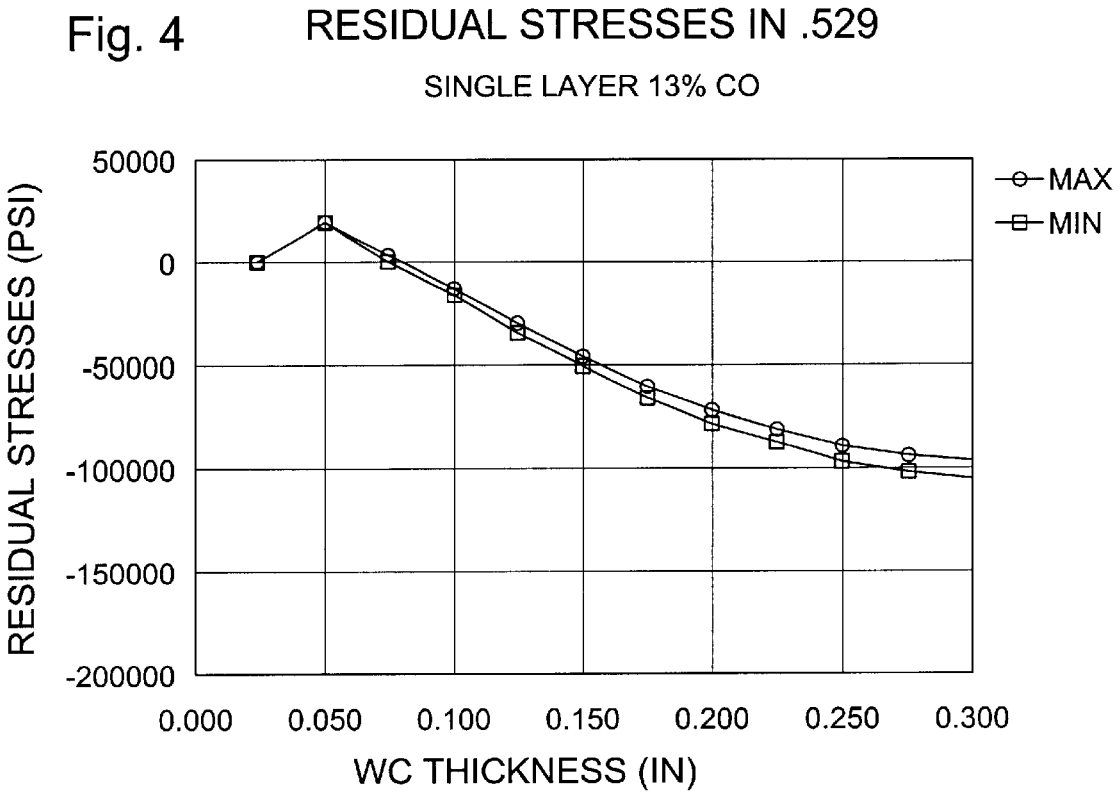

MULTIPLE GRADE CARBIDE FOR DIAMOND CAPPED INSERT

CROSS-REFERENCE TO RELATED APPLICATION

This invention is a continuation-in-part of application Ser. No. 09/231,350, filed Jan. 13, 1999 now U.S. Pat. No. 6,220,375.

TECHNICAL FIELD

This invention relates to polycrystalline diamond inserts for use in rolling cone earth-boring bits. Specifically, this invention relates to tungsten carbide inserts with a diamond cap and which have multiple layers within the carbide body that vary in mechanical properties to reduce residual stress at the interface between the diamond cap and the carbide body.

BACKGROUND ART

Earth-boring bits of the type concerned herein have a body with at least one bearing pin. A rolling cone rotatably mounts to the bearing pin. Some cones use teeth integrally formed in the metal of the cone. Others use tungsten carbide inserts pressed into mating holes in the cone. Each insert has a cutting end that protrudes from the hole for engaging the earth formation.

Originally, the inserts were formed entirely of sintered tungsten carbide. In more recent years, however, some have been capped with a diamond layer. The diamond layer is typically formed on the carbide body in a high temperature-high pressure (HTHP) sintering process. In the process, polycrystalline diamond ("PCD") powder is placed in a refractory container. A pre-sintered carbide body is inserted into the container. Then high pressure and high temperature are applied to sinter the PCD to the carbide body. It is known that PCD layers inherently have residual stresses at the interface between the tungsten carbide material and the polycrystalline diamond material. The carbide material, being already sintered, shrinks very little in the HTHP process, while the diamond material will shrink during the process. There is a substantial mismatch of the coefficient of thermal expansion of the PCD layer and the carbide support as the part is cooled down from the HTHP apparatus. The difference in shrinkage results in stress at the interface between the PCD layer and the tungsten carbide body. Fracturing of the PCD layer can result, often occurring at the interface between the PCD layer and the carbide body. This can result in delamination under the extreme temperatures and forces of drilling.

Various solutions have been suggested in the art for modifying the residual stresses existing between a diamond layer and tungsten carbide body. In one technique, the interface geometry is reconfigured to redistribute the stresses. A variety of interface configurations have been disclosed and used.

SUMMARY OF INVENTION

In this invention, an insert is provided for an earth-boring bit of the type having a rolling cone. The inserts are pressed into mating holes in the cone. Each insert has a cutting end that protrudes from the hole in the cone for engaging the earth formation. Each of the inserts has a cylindrical base that locates within one of the holes and a convex end that protrudes from the hole. A polycrystalline diamond cap is bonded to the convex end.

The body is formed of a plurality of elements or layers of carbide material. Each of the layers is free of diamond material, but differs from the other layers in mechanical properties, particularly in the modulus of elasticity and the coefficient of thermal expansion (CTE). The differences are selected to reduce stress at the interface between the convex end and the diamond cap. A higher modulus of elasticity, which is harder and less elastic, is adjacent the diamond layer for providing highly stable support. The layers spaced from the diamond layer have a lesser modulus of elasticity for avoiding excessive brittleness and providing toughness. Also, the CTE of the carbide layer adjacent the diamond layer would be lower than the next adjacent layer.

The different mechanical properties may be achieved by at least the following three different methods: (1) varying the percentage of binder in the carbide; (2) varying the average grain size of the carbide in the carbide layer; or (3) varying the binders from one material to another material. Normally, performing any one of the three methods will result in not only a change in modulus of elasticity but also a change in CTE. Combinations of these three methods may also be made.

In the preferred embodiment, each layer has a different percentage of binder material relative to the carbide material. Preferably the layer with the lowest percentage of binder material is bonded directly to the PCD layer, this layer having the highest modulus of elasticity and the lowest CTE. The layer with the highest percentage of binder material is farthest from the PCD layer, this layer having the lowest modulus of elasticity and the highest CTE. If the average grain size of the carbide material is varied, the carbide material in the layer next to the diamond layer may be of smaller dimension than the average grain size of the other layers. If the binder material itself is varied, some of the layers may contain nickel as the binder, or nickel alloyed with cobalt. The layer with the most cobalt content should be adjacent the PCD layer.

BRIEF DESCRIPTION OF THE DRAWINGS

FIG. 2 is a sectional view of one of the inserts of the bit of FIG. 1.

FIG. 3 is a sectional view of the insert of FIG. 2, taken along the line 3—3 of FIG. 2.

FIG. 4 is a graph illustrating residual stresses conducted on an insert having a PCD layer and a body of tungsten carbide with a 13% cobalt content.

DESCRIPTION OF THE PREFERRED EMBODIMENTS

Figure 1:
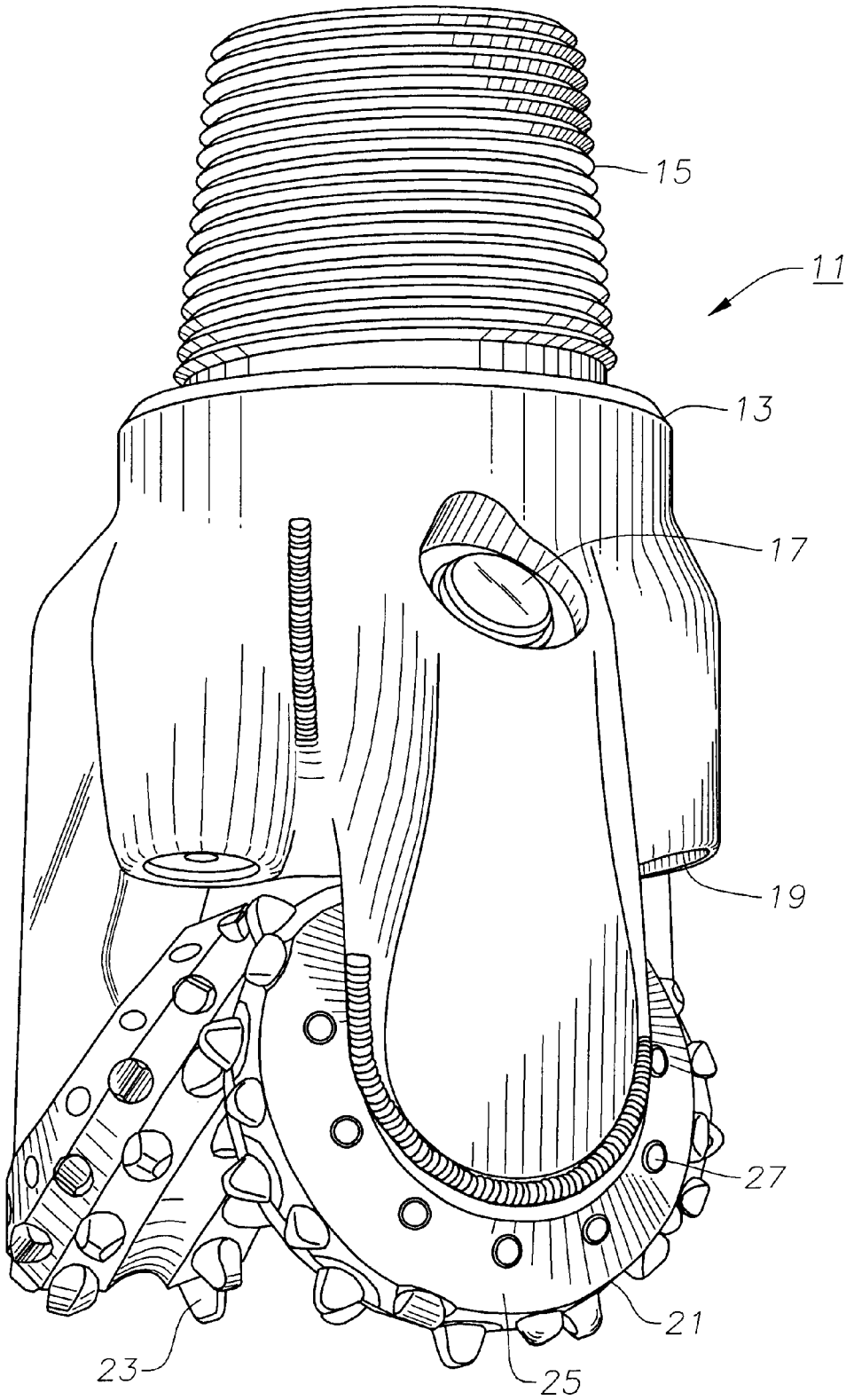
FIG. 1 is a perspective view of an earth-boring bit of the rolling cone variety with inserts constructed in accordance with this invention.

Referring to FIG. 1, earth-boring bit 11 has a body 13 with a threaded upper end 15 for attachment to a string of drill pipe (not shown). Body 13 contains three lubricant compensators 17 (only one shown) and three nozzles 19 (only two shown). A plurality of cones 21 are rotatably mounted to depending bearing pins. Each cone 21 has a plurality of cutting elements or inserts 23. Each insert 23 is pressed into a mating hole in the support metal of each cone 21. Inserts 23 are located in rows that extend circumferentially around each cone 21. Each cone 21 also has a gage surface 25 with a plurality of gage inserts 27. Gage inserts 27, unlike inserts 23, are flat, but are also pressed into mating holes in the support metal of one of the cones 21.

FIG. 2 illustrates one of the inserts 23. Insert 23 has a cutting end with a chisel shape, although alternately it maybe hemispherical, ovoid, conical or other shapes. Insert 23 has a body 29 that is formed of a carbide material, preferably tungsten carbide. Body 29 has a cylindrical base 31 that is interferingly pressed into one of the mating holes in one of the cones 21 (FIG. 1). Body 29 also has a convex end 33 that protrudes from one of the holes. A PCD or diamond cap 35 is bonded to convex end 33.

Insert body 29 is made up of at least two different elements, regions or layers of carbide material. The regions of carbide material are free of any diamond material, but different in mechanical properties so as to reduce residual stresses at the interface with diamond cap 35. In the first embodiment, three layers are shown, these being an outer or upper layer 37, an intermediate layer 39 and a lower or inner layer 41. Upper layer 37 has an upper or outer end that bonds to diamond cap 35. Intermediate layer 39 has an outer or upper end that bonds to the lower end of upper layer 37. Lower layer 41 extends from the lower end of base 31 up into convex end 33 and is bonded to the lower side of intermediate layer 39. In this embodiment, the upper side of upper layer 37 is convex and the lower side of upper layer 37 is concave. The words "convex" and "concave" are used in a broader sense than merely a portion of a sphere and refer to generally a protrusion and a depression respectively. Similarly, in this embodiment, intermediate layer 39 has a convex upper side and a concave lower side. Also, in this embodiment, both layers 37, 39 are entirely located within the convex end 33 above the junction of convex end 33 with base 31.

One mechanical property that may be varied is the modulus of elasticity. Upper layer 37 preferably has the highest modulus of elasticity, and thus is more brittle and less elastic than layers 39 and 41. Lower layer 39 has the lowest modulus of elasticity, and thus is the most elastic for providing toughness. Another mechanical property that may be varied is the coefficient of thermal expansion (CTE). Upper layer 37 preferably has a lower CTE than layers 39 and 41 so as to more closely match the CTE of diamond cap 35. These two mechanical properties generally correspond with each other, in that increasing the modulus of elasticity also decreases the CTE. However, it is possible for upper layer 37 to have the highest modulus of elasticity, but not the lowest CTE, or the lowest CTE but not the highest modulus of elasticity. Similarly, it is possible for lower layer 41 to have the lowest modulus of elasticity, but not the highest CTE, or the highest CTE but not the lowest modulus of elasticity.

The mechanical properties of the layers 37, 39 and 41 may be varied in at least three different manners: (1) varying the percentage of binder in the carbide; (2) varying the average grain size of the carbide particles forming the carbide layer; or (3) varying the binders from one material to another material. These three methods may be combined, also, to reach a desired difference in mechanical properties.

In the first method, layer 37, which is bonded to the diamond layer 35, has the lowest binder content. The lower binder content, though more brittle, is closer to diamond in mechanical properties than that of higher binder content. A lower binder content creates a higher modulus of elasticity and a higher CTE to allow more compliance to provide a tough, supporting base. In the embodiment of FIG. 2, first layer 37 might have a binder content of about 6%, second layer a binder content of about 9%, and third layer a binder content of about 16%. The choice of binders is selected from a group consisting of cobalt or nickel and alloys formed from combinations of those metals or alloys of those metals in combination with other materials or elements. Varying the binder content, as described, results in a highest modulus of elasticity at upper layer 37 and a lowest modulus of elasticity at lowest layer 41.

Another technique for varying the mechanical properties of the various layers is to change the average grain size of the carbide material. The finer average grain size is preferably located in the layers closer to the diamond layer, and the larger average grain sizes of carbide material is located farther from the diamond layer. The finer average grain size produces a higher modulus of elasticity and a lower CTE. A larger average grain size allows slight compliance, thus provide more toughness and a lower modulus of elasticity. In a preferred embodiment, the finer average grain size would be located in first layer 37 and the coarser average grain size would be located in third layer 41. The second layer 39 may have an intermediate average grain size. As an example, an average grain size for first layer 37 would be less than 2 microns, an average grain size for second layer 39 would be between 2 and 5 microns, and an average grain size for third layer 39 would be greater than 5 microns.

Another method to vary mechanical properties of the tungsten carbide material, would be to use nickel or a nickel-cobalt alloy as a binder, rather than cobalt. The binder with the higher cobalt content should be closest to the diamond layer. As an example, first layer 37 would have a cobalt binder free of nickel alloy, second layer 39 a cobalt-nickel alloy binder, and third layer 41 a nickel binder. The lowest modulus of elasticity and highest CTE would normally be in third layer 41, with the highest modulus of elasticity and lowest CTE in first layer 37.

In the manufacturing of insert 23, there are at least two ways to form carbide body 29. One method is to form the three different layers 37, 39, 41 simultaneously. This may be done by placing loose carbide powder and binder in mold at the desired percentage for first layer 37. Then loose carbide powder and binder are placed on top of the first layer material in a relative percentage selected for intermediate layer 39. Then the remainder of the mold is filled with carbide powder and binder with a content selected to achieve the desired level for lower level 41. The same would be followed for different average grain sizes of carbide, and for different binder metals. The body 29 is then sintered under pressure and temperature, preferably under a rapid process that does not allow blending of the binder significantly from one layer to another. One known process accomplishes this by rapid omni-directional compaction, known as "ROC". This is a process is offered by Kennametal of Latrobe, Pa. In this process, the loose powders are pressed and temporarily bonded with wax to form body 29. Body 29 is heated to dry the wax, and placed in a collapsible porous ceramic container along with glass pieces. The container is heated in a die to cause molten glass to surround the body. High pressure is applied to the glass in the die, causing the container to collapse, sintering the powdered metals of body 29.

Rather than form layers 37, 39, 41 simultaneously, layers 37, 39, 41 could be separately sintered in a conventional process, then secured together by brazing to form body 29. After body 29 is preformed, diamond layer 35 is then formed on carbide body 29 in a conventional manner. This is preferably done by an HTHP process wherein diamond powder is placed in the container. The preformed carbide body 29 is placed in the container, then high pressure and temperature are applied to sinter diamond layer 35 to body 29. The layers 37, 39, 41 could also be separately formed and placed in an HTHP die along with diamond powder. The layers 37, 39, 41 would be joined together in the HTHP die while the diamond layer 35 is being sintered.

Figure 5:
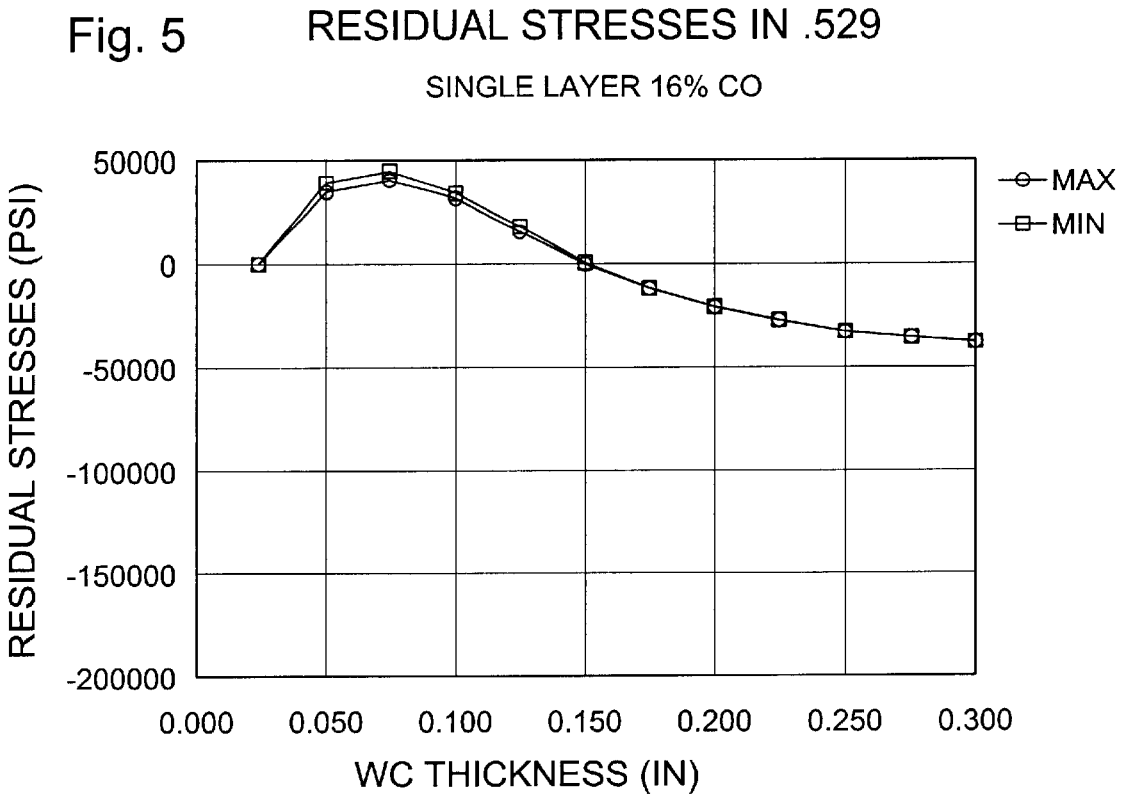
FIG. 5 is a graph illustrating residual stresses conducted on an insert having a PCD layer mounted to a tungsten carbide body having a 16% cobalt binder content.
Figure 6:
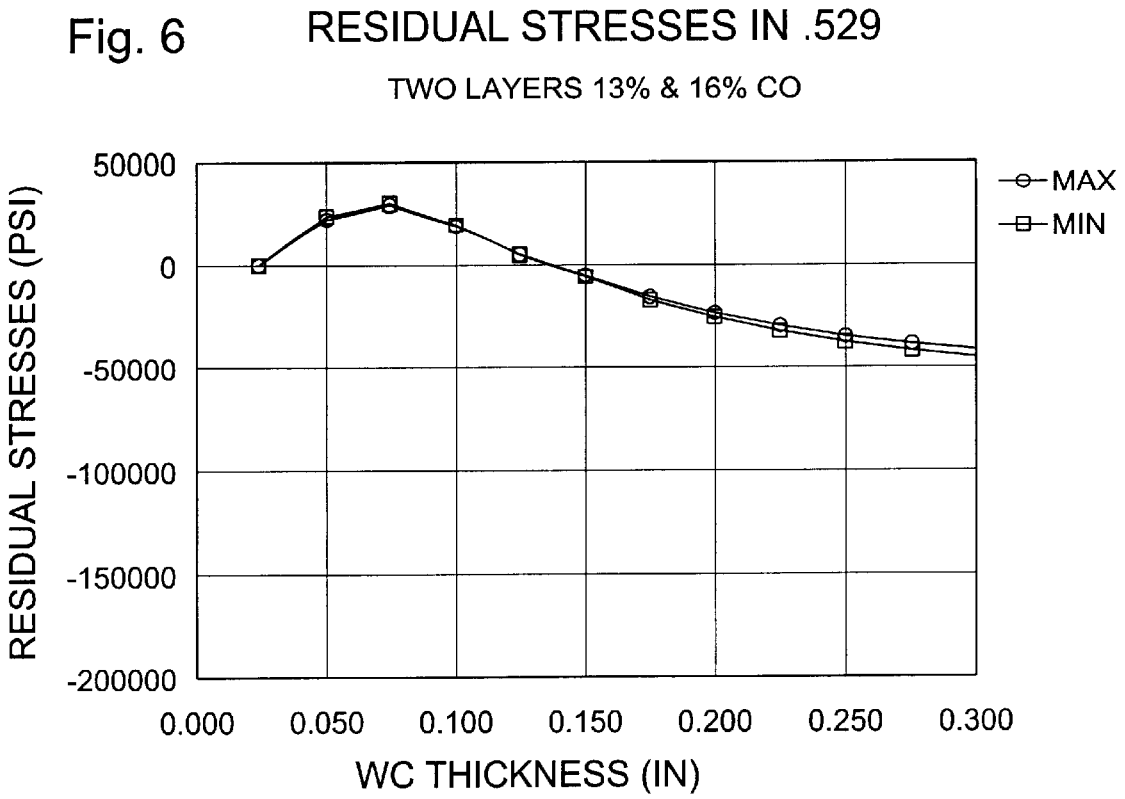
FIG. 6 is a graph illustrating residual stresses conducted on an insert having a PCD layer on a tungsten carbide body, the body having a first layer of 13% cobalt binder content bonded to the diamond layer, and a second layer of 16% cobalt binder content.

FIGS. 4–6 illustrate how multiple layers with different mechanical properties can reduce stress at the interface between a carbide body and a diamond layer. In FIG. 4, a diamond layer was applied to a carbide body that homogeneously contained 13% cobalt as a binder. Then a transducer was attached to the diamond layer and the carbide was incrementally ground off, one level at a time. The stress measured by the transducer was monitored as the carbide layer became thinner. The "x" axis represents the residual stresses that exist as the carbide is ground off from the diamond. At approximately the 0.02 inch point, only 0.02 inch of carbide remains attached to the diamond layer. The stress in the diamond layer is approximately zero at this point. When approximately 0.050 inch remains of carbide, there is actually a positive residual stress of about 2000 psi in the diamond layer. A positive reading indicates tensile stress, while a negative reading indicates compressive stress. When the carbide is at full thickness of 0.3 inch, the stress in the diamond layer is compressive at 100,000 psi. Although compressive stress is preferable to a tensile stress, 100,000 psi compressive stress is considered undesirable.

In FIG. 5, the carbide body had 16% cobalt homogeneously dispersed throughout as a binder. Note that when the carbide level was ground down to the range from 0.05 to about 0.120 inch, the stresses in the diamond layer were tensile. When more thickness was left of the carbide body, the stresses became compressive. At the thickness of 0.30 inch, the diamond layer had a compressive stress of about 40,000 psi, less than the specimen of FIG. 4.

In FIG. 6, the specimen was made of a diamond layer located on a carbide layer having 13% cobalt content. The carbide layer of 13% cobalt content was bonded to a carbide layer having 16% cobalt content. This specimen provided the best results. At the full thickness of 0.30 inch, the compressive stress was approximately the same as in the specimen of FIG. 5, which contained 16% cobalt throughout. However, as can be seen from approximately 0.050 inch to 0.150 inch, the tensile stresses resulting are much less than that of the test of FIG. 5. Consequently, the overall stresses resulting at the interface between the diamond layer and the 13% cobalt layer is less when the 13% cobalt layer is sintered to a 16% cobalt layer.

Figure 7:
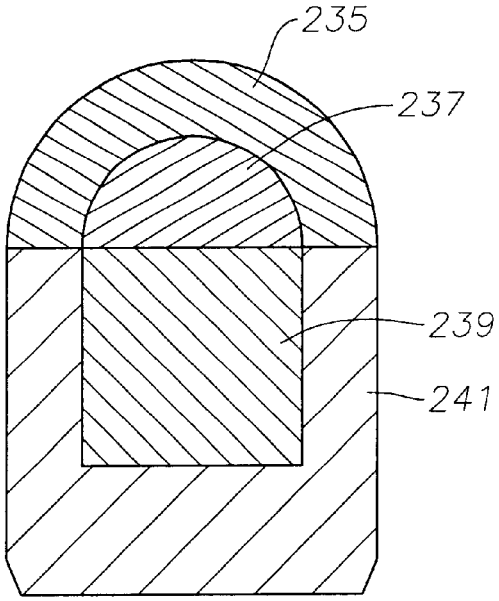
FIG. 7 is a sectional view of an alternate embodiment of an insert constructed in accordance with the invention.

FIGS. 7–10 illustrate alternate embodiments of an insert, having different configurations for the various carbide layers, regions or elements. In FIG. 7, diamond layer 235 entirely overlies an upper core element 237 of carbide material, which is entirely located in the convex end of the insert. Upper core element 237 is hemispherical with a flat bottom that coincides with the upper end of a base portion 241 of the insert. Base portion 241 is of carbide material and has a flat bottom and cylindrical sidewalls. A lower core element 239 of carbide material has an upper end that abuts the flat bottom of upper core element 237 and extends downward into the base 241. Lower core element 239 is cylindrical. The diameter of lower core element 239 and upper central core element 237 is smaller the diameter of base 241. The lower end of lower core element 239 is spaced above the bottom of base 241.

The various elements 235,237,239 and 241 are preferably separately formed and joined as discussed in connection with the first embodiment. The mechanical properties of the elements 237, 239 and 241 vary as discussed in connection with the first embodiment. Preferably upper core element 237 has either the highest modulus of elasticity or lowest CTE or both. Base 241 has the lowest modulus of elasticity of highest CTE or both. Lower core element 239 has a modulus of elasticity between base 241 and upper core element 237. Alternately, lower core element 239 could have the same mechanical properties as upper core element 237 and be joined as a single element.

Figure 8:
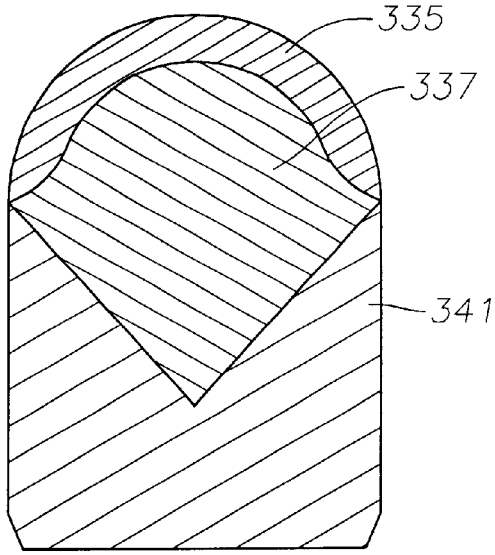
FIG. 8 is a sectional view of another alternate embodiment of an insert constructed in accordance with the invention.

In FIG. 8, diamond layer 335 overlies a core 337 of carbide material. Core 337 is generally diamond shaped in cross-section, having a conical portion that extends downward into a carbide base 341 and a rounded portion that extends upward into the convex portion of the insert under diamond layer 335. Base 341 has cylindrical side walls that extend to the top of the conical portion of core 337. The apex of the conical portion of core 337 terminates above the bottom of base 341. Core 337 and base 341 are preferably formed separately and joined and have different mechanical properties as discussed above. Core 337 would preferably have either a higher modulus of elasticity or a lower CTE than base 341, or both.

Figure 9:
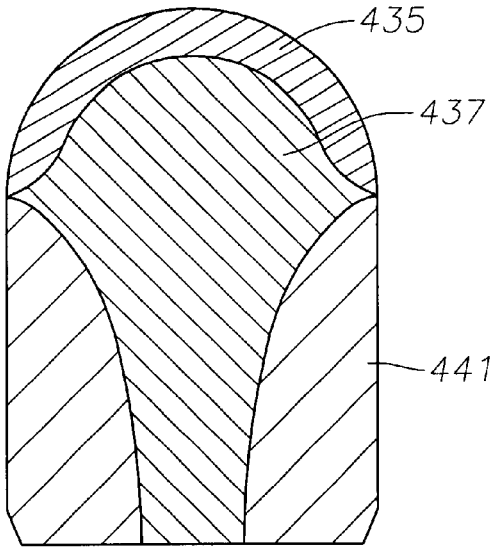
FIG. 9 is a sectional view of another alternate embodiment of an insert constructed in accordance with the invention

In FIG. 9, diamond layer 435 overlies a core 437 of carbide material. Core 437 has a rounded upper end and a lower portion that extends completely to the bottom of the insert. The lower portion of core 437 flares outward in an upward direction, creating a mushroom-like configuration for core 437. A base 441 surrounds the lower portion of core 437, having a bottom flush with the bottom of core 437 and an upper end that joins the lower edge of diamond layer 437. Diamond layer 435, core 437 and base 441 are preferably formed simultaneously in an HTHP process as discussed above. The mechanical properties of core 437 and base 441 differ, with core 437 having either a higher modulus of elasticity or a lower CTE or both.

Figure 10:
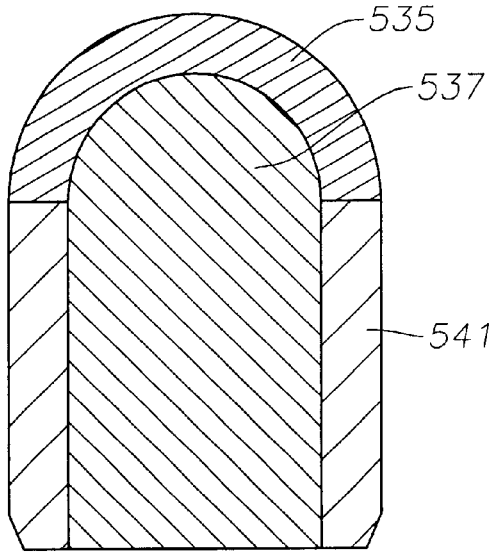
FIG. 10 is a sectional view of another alternate embodiment of an insert constructed in accordance with the invention

In FIG. 10, diamond layer 535 overlies a central core 537 of carbide material. Core 537 has a rounded upper end, cylindrical sidewalls and a flat bottom located at the bottom of the insert. A base 541 of carbide material surrounds the cylindrical sidewalls of core 537. Base 541 has an upper end that joins the lower edge of diamond layer 535. Core 537 and base 541 may be formed separately and joined as described above. The mechanical properties of core 537 and base 541 differ, with core 537 having either a higher modulus of elasticity or a lower CTE or both.

The invention has significant advantages. By utilizing at least two carbide layers having different mechanical properties, the stress can be reduced at the interface between the diamond and the carbide. The interfaces between the various regions of carbide material can be smooth if desired.

While the invention has been shown in only a few of its forms, it should be apparent to those skilled in the art that it is not so limited, but susceptible to various changes without departing from the scope of the invention.

We claim:

1. An earth boring bit, comprising:

a body having at least one depending bearing pin;

a rolling cone rotatably mounted to the bearing pin;

a plurality of inserts, each pressed into a mating hole in the cone and having a cutting end that protrudes from the hole for engaging an earth formation;

each of the inserts comprising a bode having a cylindrical base that locates within one of the holes and a convex end that protrudes from the hole;

a polycrystalline diamond cap bonded to the convex end; and the body being formed of carbide material with at least two regions of the carbide material at least partially located within the convex end of the insert that are free of diamond material but differ from each other in mechanical properties to reduce stress at an interface between the convex end and the diamond cap.

2. The bit according to claim 1, wherein each of the regions has a different percentage of binder material within the carbide material.

3. The bit according to claim 1, wherein each of the regions has a different percentage of cobalt as a binder material.

4. The bit according to claim 1, wherein the diamond cap is bonded to a first one of the regions, and a second one of the regions is bonded to the first one of the regions; and wherein the second one of the regions has a greater percentage of cobalt as a binder than the first one of the regions.

5. The bit according to claim 1, wherein one of the regions is located substantially in the cutting end of the body, and at least a portion of another of the regions is located in the base of the body.

6. The bit according to claim 1, wherein each of the regions has a different average grain size of carbide material.

7. The bit according to claim 1, wherein the diamond cap is bonded to an outer side of a first one of the regions, and a second one of the regions is bonded to an inner side of the first one of the regions; and wherein the first one of the regions has a smaller average grain size than the second one of the regions.

8. The bit according to claim 1, wherein one of the regions has a binder consisting of cobalt and another one of the regions has a binder selected from the group consisting of nickel and cobalt-nickel alloy.

9. The bit according to claim 1, wherein the diamond cap is bonded to an outer side of a first one of the regions, and a second one of the regions is bonded to an inner side of the first one of the regions; and wherein the first one of the regions has a binder consisting of cobalt and the second one of the regions has a binder selected from the group consisting of nickel and cobalt-nickel alloy.

10. The bit according to claim 1, wherein the diamond cap is bonded to an outer side of a first one of the regions, and a second one of the regions is bonded to the an inner side of the first one of the regions; and wherein the first one of the regions has a greater modulus of elasticity than the second one of the regions.

11. The bit according to claim 1, wherein the diamond cap is bonded to an outer side of a first one of the regions, and a second one of the regions is bonded to the an inner side of the first one of the regions; and wherein the first one of the regions has a lesser coefficient of thermal expansion than the second one of the regions.

12. An earth boring bit, comprising:

a body having at least one depending bearing pin;

a rolling cone rotatably mounted to the bearing pin;

a plurality of inserts, each pressed into a mating hole in the cone and having a cutting end that protrudes from the hole for engaging an earth formation;

each of the inserts comprising a carbide body having a cylindrical base that located within one of the holes and a convex end that protrudes from the hole;

a polycrystalline diamond cap bonded to the convex end;

the body having a first region of carbide material at least partially located in the convex end that is free of diamond material and bonds to an inner side of the diamond cap;

the body having a second region of carbide material at least partially located in the convex end that is free of diamond material, the first region having a higher modulus of elasticity than the second region.

13. The bit according to claim 12, wherein the inner side of the diamond cap is concave, and the first region has a convex outer side and a concave inner side.

14. The bit according to claim 12, wherein the first region has a lower coefficient of thermal expansion than the second region.

15. An earth boring bit, comprising:

a body having at least one depending bearing pin;

a rolling cone rotatably mounted to the bearing pin;

a plurality of inserts, each pressed into a mating hole in the cone and having a cutting end that protrudes from the hole for engaging an earth formation;

each of the inserts comprising a body having a cylindrical base that located within one of the holes and a convex end that protrudes from the hole;

a polycrystalline diamond cap bonded to the convex end;

the body having a first region of carbide material located in the convex end that is free of diamond material and bonds to an inner side of the diamond cap;

the body having a second region of carbide material located in the convex end that is free of diamond material, the first region having a higher modulus of elasticity than the second region; and wherein the first region has a conical portion that extends into the base, the base comprising the second region.

16. An earth boring bit, comprising:

a body having at least one depending bearing pin;

a rolling cone rotatably mounted to the bearing pin;

a plurality of inserts, each pressed into a mating hole in the cone and having a cutting end that protrudes from the hole for engaging an earth formation;

each of the inserts comprising a body having a cylindrical base that locates within one of the holes and a convex end that protrudes from the hole;

a polycrystalline diamond cap bonded to the convex end;

the body having a first region of carbide material located in the convex end that is free of diamond material and bonds to an inner side of the diamond cap;

the body having a second region of carbide material located in the convex end that is free of diamond material, the first region having a higher modulus of elasticity than the second region; and wherein the first region has a portion that extends into the base and has a bottom that is flush with a bottom of the base, the base being the second region and being a sleeve surrounding the first region.

17. An earth boring bit, comprising:

a body having at least one depending bearing pin;

a rolling cone rotatably mounted to the bearing pin;

a plurality of inserts, each pressed into a mating hole in the cone and having a cutting end that protrudes from the hole for engaging an earth formation;

each of the inserts comprising a body having a cylindrical base that locates within one of the holes and a convex end that protrudes from the hole;

a polycrystalline diamond cap bonded to the convex end;

the body having a first region of carbide material located in the convex end that is free of diamond material and bonds to an inner side of the diamond cap;

the body having a second region of carbide material located in the convex end that is free of diamond material, the first region having a higher modulus of elasticity than the second region; and wherein the second region is a cylindrical element located within and surrounded by the base, the base being of a carbide material that has a lesser modulus of elasticity than the second region.

18. An earth boring bit, comprising:

a body having at least one depending bearing pin;

a rolling cone rotatably mounted to the bearing pin;

a plurality of inserts, each pressed into a mating hole in the cone and having a cutting end that protrudes from the cone for engaging an earth formation;

each of the inserts comprising a carbide body having a cylindrical base that locates within one of the holes and a convex end that protrudes from the hole;

a polycrystalline diamond cap bonded to the convex end; and the body being formed of a plurality of regions of carbide material that are at least partially located in the convex end of the insert and free of any diamond material, each of the regions having a metallic binder, a first one of the regions having a lesser percentage of binder than a second one of the regions, the diamond cap being bonded to an outer side of the first one of the regions.

19. The bit according to claim 18, wherein the second one of the regions is bonded to an inner side of the first one of the regions, and wherein the bit further comprises a third one of the regions that is bonded to the second one of the regions, the third one of the regions having a greater percentage of binder than the second one of the regions.

20. The bit according to claim 18, wherein the regions are free of diamond material.

21. An earth boring bit, comprising:

a body having at least one depending bearing pin;

a rolling cone rotatably mounted to the bearing pin;

a plurality of inserts, each pressed into a mating hole in the cone and having a cutting end that protrudes from the cone for engaging an earth formation;

each of the inserts comprising a carbide body having a cylindrical base that locates within one of the holes and a convex end that protrudes from the hole;

a polycrystalline diamond cap bonded to the convex end; and the body being formed of a first region of carbide material to which the diamond cap is bonded, and a second region of carbide material, both of the regions being at least partially located in the convex end of the insert and being free of any diamond material, the first region having an average grain size that is smaller than an average grain size of the second region of carbide material.

22. The bit according to claim 21, wherein the regions are free of any diamond material.

23. The bit according to claim 21 wherein the second region is bonded to an inner side of the first region, and wherein the bit further comprises a third region that is bonded to the second region, the third region having an average grain size that is larger than an average grain size of the second region.

24. An earth boring bit, comprising:

a body having at least one depending bearing pin;

a rolling cone rotatably mounted to the bearing pin;

a plurality of inserts, each pressed into a mating hole in the cone and having a cutting end that protrudes from the cone for engaging an earth formation;

each of the inserts comprising a body having a cylindrical base that locates within one of the holes, a convex end that protrudes from the hole, and a polycrystalline diamond cap bonded to the convex end; and the body being formed of a first region of carbide material to which the diamond cap is bonded, and a second region of carbide material, both of the regions at least partially located in the convex end of the insert and being free of any diamond material, the first region of carbide material having a binder consisting of cobalt, the second region having a binder from the group consisting of nickel and cobalt-nickel alloy.

25. The bit according to claim 24, wherein the first region has a higher modulus of elasticity and lower coefficient of thermal expansion than the second region.

* * * * *